US007520756B2

(12) United States Patent
Nagata

(10) Patent No.: US 7,520,756 B2
(45) Date of Patent: Apr. 21, 2009

(54) MIDDLE ELECTRICAL CONNECTOR

(75) Inventor: Masakazu Nagata, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/987,317

(22) Filed: Nov. 29, 2007

(65) Prior Publication Data

US 2009/0068902 A1 Mar. 12, 2009

(30) Foreign Application Priority Data

Sep. 11, 2007 (JP) ..... 2007-234810

(51) Int. Cl.
*H01R 12/00* (2006.01)

(52) U.S. Cl. ..... 439/74

(58) Field of Classification Search ..... 439/74, 439/65, 79, 630, 637, 76.1, 262
See application file for complete search history.

(56) References Cited

U.S. PATENT DOCUMENTS 6,537,087 B2 * 3/2003 McNamara et al. ..... 439/108
6,872,085 B1 * 3/2005 Cohen et al. ..... 439/108
7,104,808 B2 * 9/2006 Korsunsky et al. ..... 439/76.1
7,108,567 B1 * 9/2006 Korsunsky et al. ..... 439/701
7,267,515 B2 * 9/2007 Lappohn ..... 439/608

FOREIGN PATENT DOCUMENTS

JP 2004-111140 4/2004

* cited by examiner

*Primary Examiner*—Alexander Gilman
(74) *Attorney, Agent, or Firm*—Kubotera & Associates, LLC

(57) ABSTRACT

A middle electrical connector includes a plurality of terminals disposed on a terminal arrangement plate. A housing holds the terminal arrangement plate. The terminal arrangement plate has retaining grooves to hold the terminals at a plurality of positions. The retaining grooves includes a front retaining groove and a back retaining groove having at least one of a shape or a size different with each other. The front retaining groove holds a front retained portion of the terminal on a front portion side. The rear retaining groove holds a rear retained portion of the terminal on a rear portion side. When the terminal is inserted, the front retained portion is allowed to pass through the rear retaining groove.

11 Claims, 10 Drawing Sheets

MIDDLE ELECTRICAL CONNECTOR

BACKGROUND OF THE INVENTION AND RELATED ART STATEMENT

The present invention relates to a middle electrical connector intervening between two connectors to connect the two connectors.

A conventional middle electrical connector has a middle member. Two mating connectors are fitted into the middle member to electrically connect with each other through the middle member. The middle member includes an arrangement plate made formed of an insulation member, and is provided with a terminal on a surface of the arrangement plate. The terminal extends between two edge portions of the arrangement plate situated on opposite sides thereof, so that the two mating connectors are fitted into the middle electrical connector in the edge portions. The terminal and the arrangement plate may be molded together to hold the terminal on the arrangement plate. However, a cost of such a molding method is generally high.

Instead of molding the terminal and the arrangement plate together, an arrangement plate may be structured to hold a terminal as disclosed in Patent Reference. In Patent Reference, a recess portion has a groove shape to accommodate the terminal on a surface of the arrangement plate. Accordingly, the terminal having a strip shape may be pressed to fit into the recess portion from a direction perpendicular to a terminal arrangement plate surface to be held. Further, an opening edge portion of the recess portion is pressed to crush in order to securely hold the terminal.

Patent Reference Japanese Patent Publication No. 2004-111140

However, according to Patent Reference, improvements may be necessary. Such improvements include a mechanical issue relating to how to attach the terminal to the arrangement plate and an electrical issue relating to the terminal attached to the arrangement plate.

First, from a mechanical point of view, the terminal is formed in a long strip shape, and an entire length of the terminal is pressed to fit into the recess portion of the arrangement plate having a groove shape evenly. Further, it is necessary to press and crush an opening edge portion of the recess portion, so that the terminal is held securely. Accordingly, a manufacturing process becomes complicated. When a pressing force to crush is too strong, the terminal and the arrangement plate may be damaged and may fail to hold securely due to the damage. Further, when the pressing force to crush is too weak, the terminal and the arrangement plate may not be able to hold enough.

Next, from an electrical point of view, the terminal may form an imperceptible space without closely contacting the arrangement plate surface depending on an amount of the pressing force of the terminal against the recess portion. Further, when at least one of the terminal and the arrangement plate has a plane surface that is warped and is not a perfect plane surface, a space may be created in a portion that is not a plane even though the terminal and the arrangement plate are closely contacted in other portions.

Since the terminal has an extremely long length compared to a width and a thickness thereof, it is difficult to closely contact each other over the entire length. The space of this type has layers of air that deteriorates a transmission characteristic upon high-speed transmission.

In consideration to the issues described above, an object of the present invention is to provide a middle electrical connector having a middle member. In the middle electrical connector, a terminal can be attached to an arrangement plate with ease regardless of a length of the terminal. Further, the middle member can closely contact with an arrangement rows through an entire length and has a secured transmission characteristic.

Further objects and advantages of the invention will be apparent from the following description of the invention.

SUMMARY OF THE INVENTION

In order to attain the objects described above, according to a first aspect of the present invention, a middle electrical connector includes a plurality of terminals extending in straight from one of edge portions of a terminal arrangement plate to the other edge portion to form a middle member on a surface of the terminal arrangement plate. The terminal arrangement plate is made of an electrical insulation member. A housing made of an electrical insulation material holds the middle member. Mating connectors may be connected to one of the edge portions and the other edge portion of the middle electrical connector.

In the middle electrical connector according to the first aspect of the present invention, the terminal arrangement plate has retaining grooves to hold the terminals at a plurality of the positions in a longitudinal direction of the terminals. Different types of the retaining grooves in which at least one of a shape or a size is different are provided including a front retaining groove and a back retaining groove.

In the middle electrical connector, the terminal is inserted from a front portion of the terminal arrangement plate from one of the edge portions to the other of the edge portions along the terminal arrangement plate surface. In the front retaining groove, a retained portion of the terminal on a front portion side is held at one of the edge portions. In the rear retaining groove, a retained portion of the terminal on a rear portion side is held at one of the edge portions. In each of the retaining groves, only the retained portion of the terminal situated to correspond to the terminal at a completion of insertion of the terminal is pressed to fit into the terminal. When the terminal is inserted, the front retained portion is allowed to pass through the corresponding retaining groove.

In the present invention, with the above configuration, when the terminals are inserted into the retaining grooves of the arrangement plate, the middle member can be obtained. The terminal advances passing through the rear retaining groove situated in one of the edge portion sides with respect to the terminal arrangement plate from the front portion. When the terminal reaches a specific advancement position, each of the retaining portions provided in the front, rear, and middle portions of the terminal is pressed to fit into the front, rear, and each corresponding retaining groove, respectively, and is held to be adjacent to an arrangement surface.

When a plurality of the terminals is connected through a career on a rear edge side thereof, the terminals are inserted into the retaining grooves in a batch using the career. After the terminals are held with the arrangement plate, the career is separated from the rear edge of the terminals. The retaining groove may be a hole to pass through in an insertion direction of the terminal. Further, a part of the retaining groove may be open to an upper portion (in a direction away from the arrangement surface).

According to a second aspect of the present invention, it is preferred that at least one of the retaining grooves is in a shape to press a surface of the arrangement plate upon a press fit of the retained portion of the corresponding terminal. The retaining grooves include the front retaining groove and the rear retaining groove. The retained portions of the terminals are pressed to fit into the corresponding groove to be substantially adjacent to the arrangement surface through an entire length of the terminal. A sectional shape of the retaining groove and the retained portion is formed so as to contact each other in an upper side when pressed to fit, and the retained portion is pressed downwardly. That is, the retained portion is pressed by the arrangement surface. Accordingly, the terminal may be held with an increased contact with the arrangement surface.

According to a third aspect of the present invention, it is preferred that each of the retaining grooves from the front retaining groove to the rear retaining groove is positioned such that each of the corresponding portions can be pressed into the retained portion at the same time. Thus, the retained portion is prevented from being pressed into the retaining groove unevenly due to timing.

According to a fourth aspect of the present invention, a guide groove to guide the terminal to be inserted is provided on the arrangement side of the terminal arrangement plate. It is preferred that the guide groove communicates with all the retaining grooves from the front retaining groove to the rear retaining groove. When the terminal is inserted, the guide groove guides the terminal to determine a position in a width direction. The terminal is guided from one retaining groove to the other smoothly.

According to a fifth aspect of the present invention, the retaining groove may be provided in a protrusion portion on the arrangement surface so as to pass the retaining grooves corresponding to the retained portions of all the terminals of the same position in a front-to-rear direction.

According to a sixth aspect of the present invention, it is preferred that a regulating portion is disposed at a front position of the front retaining groove for abutting against a front edge of the terminal to regulate a position of the terminal upon completion of the insertion of the terminal. The regulating portion enables to automate an insertion of the terminal and simplify an insertion process. Further, a position to insert and retention by press-fit become more even among a plurality of the middle members.

According to a seventh aspect of the present invention, when the retaining groove is provided in the protrusion portion, it is preferred that the retaining groove communicates with window portions. The window portions pass through from the terminal arrangement surface of the terminal arrangement surface to the opposite surface in the position of the retaining groove. Accordingly, a thickness of the arrangement plate over the entire length of the terminal becomes substantially uniform. Accordingly, a partial deterioration of the transmission characteristic in the retaining groove is prevented.

According to an eighth aspect of the present invention, it is preferred that at least one of a height and a width of the retained portion of the terminal is larger than other portions connecting the retained portions in a section perpendicular to a longitudinal direction of the terminal. Accordingly, a relatively large space is created between long portions of the retained portions of the terminal and the retaining groove. Thus, the retained portion can pass through the retaining groove in the portion with ease.

According to a ninth aspect of the present invention, one of the surfaces of the terminal arrangement plate of the middle member may be provided with the retaining groove to hold the terminals and the other surface is provided with a shielding plate so as to improve a shielding characteristic.

According to a tenth aspect of the present invention, when the shielding plate is attached to the terminal arrangement plate, the other surface of the terminal arrangement plate may be provided with a protrusion and the shielding plate having an engagement hole in which the protrusion passes through. A side surface of the protrusion may be provided with a press fit groove. An inner edge of the engagement hole moves to slide along the other surface of the shielding plate and is pressed to fit into the press fit groove. The shielding plate only move to slide to be held by the terminal arrangement plate.

According to an eleventh aspect of the present invention, it is preferred that the press fit groove becomes narrower in a slide move direction of the shielding plate. It is preferred that the shielding plate is pressed by the other surface of the terminal arrangement plate through the slide move.

As described above, in the present invention, the terminals are inserted into a plurality of the retaining grooves provided in the terminal arrangement plate along the arrangement plate surface. When the terminals are completely inserted to a specific position, the terminals are pressed to fit into and held by the retaining grooves. Accordingly, the terminal is easily and securely held only through a manufacturing process of being inserted into the retaining groove. Further, the terminal may be pressed onto the arrangement plate surface in the retaining groove upon press fit. Accordingly, the entire length of the terminal closely contacts with the arrangement plate surface to improve the transmission characteristic.

DETAILED DESCRIPTION OF THE PREFERRED EMBODIMENTS

Hereunder, embodiments of the present invention will be explained with reference to the accompanying drawings.

Figure 1:
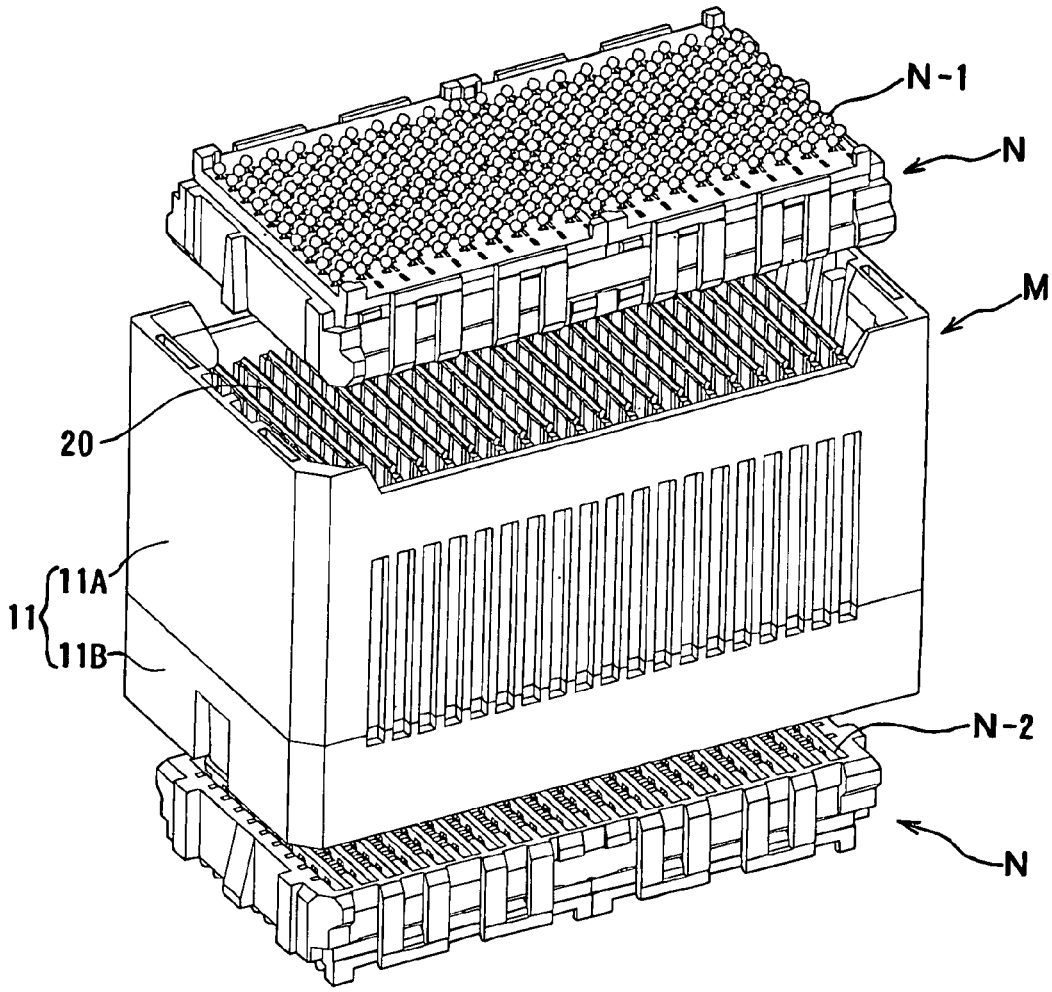
FIG. 1 is a plan view showing a middle electrical connector and board connectors to be connected thereto according to an embodiment of the present invention.

FIG. 1 is a perspective view showing a middle electrical connector M (middle connector) and board electrical connectors N (board connector N) according to an embodiment of the present invention in a state before fitting. The board connectors N are connected to the middle connector M.

In the embodiment shown in FIG. 1, the board connectors N with an identical configuration are situated above and below the middle connector M symmetrically. In FIG. 1, solder balls N-1 are provided on a top surface of the board connector N situated above the middle connector and a bottom surface of the board connector N situated below the middle connector M to connect with a circuit board (not shown). The board connector N (bottom board connector N) has a plurality of receiving grooves N-2 on an opposite side of the side provided with the solder balls N-1. Middle members of the middle connector M described below having a plate shape are inserted into the receiving grooves N-2.

Figure 2:
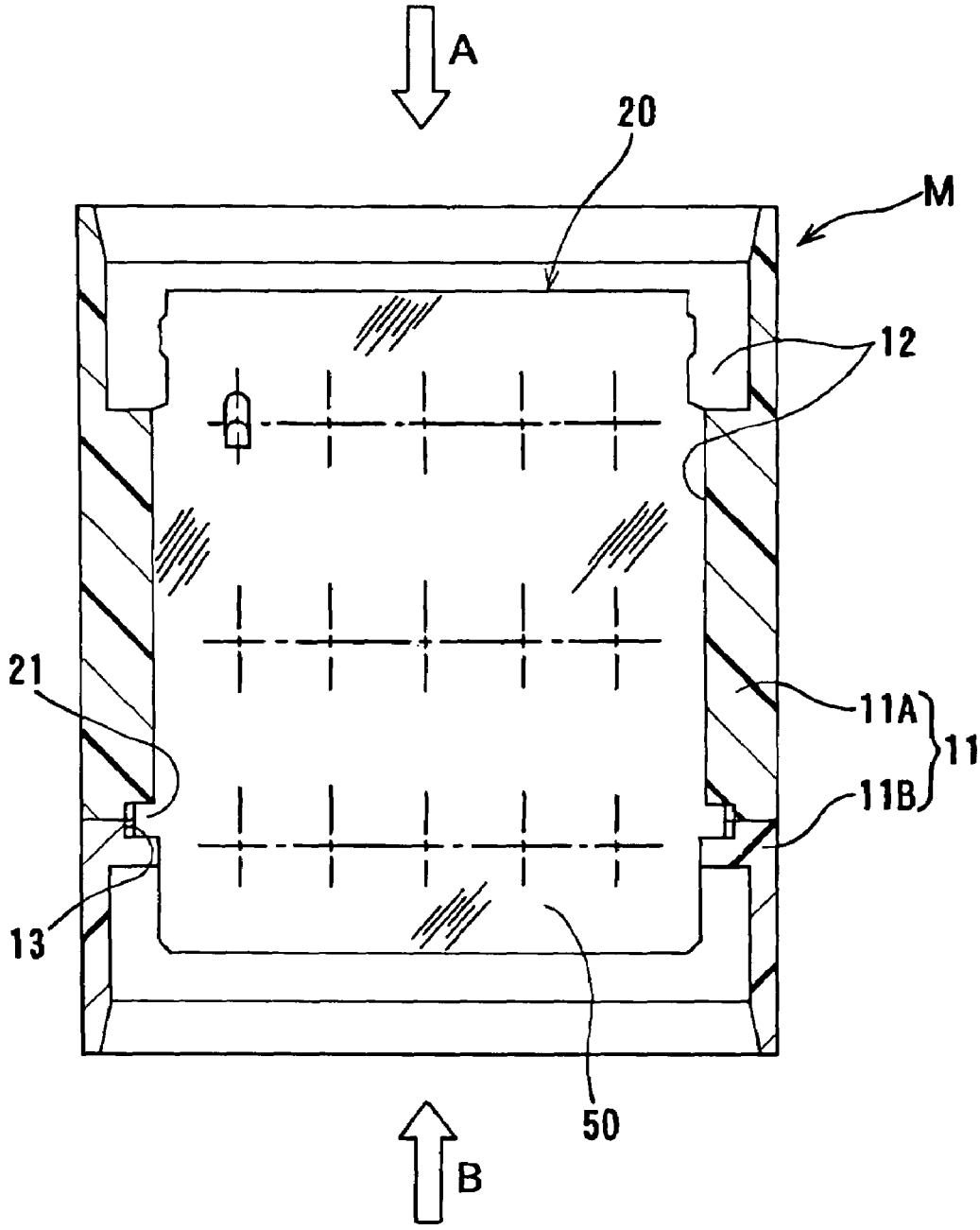
FIG. 2 is a sectional view of the middle electrical connector according to the embodiment of the present invention.

FIG. 2 is a sectional view of the middle member 20 along a surface parallel to a plate surface of the middle member 20 in FIG. 1. The middle connector M according to the embodiment has an approximate rectangular shape as shown in FIG. 2. Further, the middle connector M is provided with a housing 11 and the middle member 20. The housing 11 is provided with container grooves 12 having a slit shape and pass through in a top to bottom direction to accommodate the middle members 20. The middle member 20 is accommodated and held in the container groove 12.

Further, in the middle member 20, one of surfaces of a terminal arrangement plate (described below) made of an insulation member is provided with a plurality of the terminals parallel to each other having a strip shape, and the other surface thereof is provided with a shielding plate. The middle member 20 as a whole is in a form of a plate (a surface of the shielding plate is exposed in FIG. 2).

As shown in FIG. 2, a plurality of the middle members 20 is provided to form a plane parallel to a sheet surface to be a plate surface at a specific interval in a direction perpendicular to the sheet surface. Each of the middle members 20 is accommodated in the container groove 12 passing through in a top and bottom direction provided in the housing 11.

The housing 11 is divided into a top member 11A and a bottom member 11B. The top member 11A and the bottom member 11B are fitted into each other at an engagement portion (not shown). The top member 11A and the bottom member 11B have a cut portion formed in an inner surface of a joining portion. The cut portions created upon fitting of the top member 11A and the bottom member 11B form retaining grooves 13. The retaining grooves 13 sandwich protrusions 21 of the middle member 20 from top and bottom so as to prevent the middle member 20 from being displaced in a top to bottom direction. Top and bottom edges of the middle member 20 are situated in top and bottom opening portions of the container groove 12 of the housing 11. Further, two mating connectors (not shown) are fitted into the middle member 20 from top and bottom in directions indicated by the arrows A and B, respectively.

Figure 3:
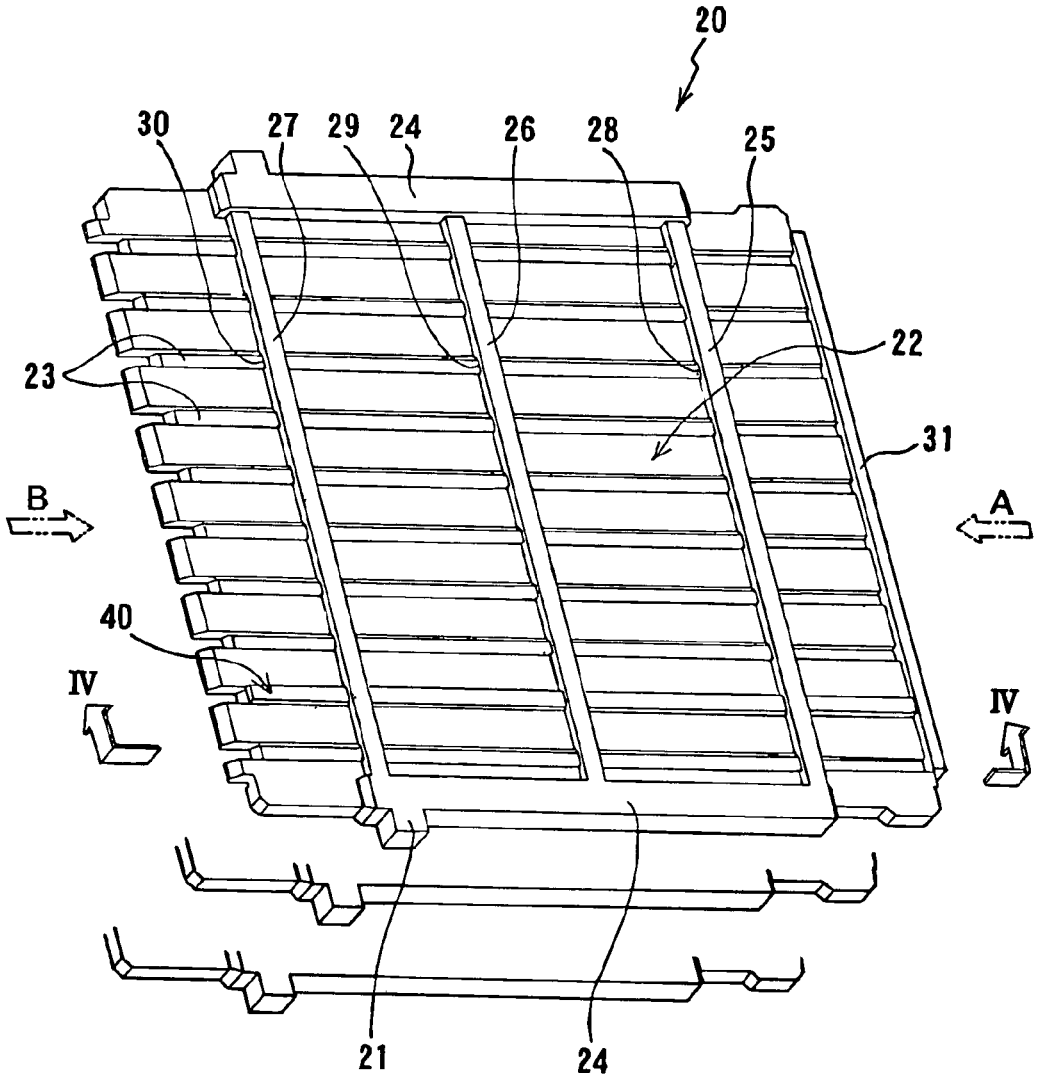
FIG. 3 is a perspective view showing a middle member of the middle electrical connector according to the embodiment of the present invention.

As described above, the housing 11 holds the plurality of the middle members 20 in parallel (refer to FIG. 3, but the housing 11 is not shown). One side of a terminal arrangement plate 22 of the middle member 20 holds terminals 40 made of an electrical insulating member shown in FIG. 3, while the other surface of the terminal arrangement plate 22 of the middle member 20 holds a shielding plate 50 made of a thin metal sheet shown in FIG. 2.

FIG. 3 shows that the terminal 40 is arranged in one of guide grooves 23 formed in parallel in one surface of the terminal arrangement plate 22. The terminals in the other guide grooves 23 are not shown. The guide groove 23 extends from a rear portion (left portion) of the terminal arrangement plate 22 to a front portion thereof. Further, a front portion (right portion in FIG. 3) of the terminal 40 is guided from the rear portion to the front portion of the guide groove 23. In addition, the terminal arrangement plate 22 is provided with the protrusions 21 on both side edges 24 parallel to the guide grooves 23.

The terminal arrangement plate 22 is provided with protrusion portions 25, 26, and 27 in each of the three positions in a direction that the guide groove 23 extends. The protrusion portions 25, 26, and 27 connect the side edges 24 on both ends. The guide groove 23 passes through the protrusion portions 25, 26, and 27, and retaining grooves 28, 29, and 30 are provided with the protrusion portions 25, 26, and 27 to hold the terminal 40.

Further, a regulating portion 31 having a step shape parallel to the protrusion portions 25, 26, and 27 is provided on a front edge of the terminal arrangement plate 22. The retaining grooves 28, 29, 30 and the regulating portion 31 will be explained as well as the terminal 40 held by the retaining grooves 28, 29, and 30 with reference to FIG. 4 showing a sectional view of FIG. 3 taken along a line IV-IV.

Figure 4:
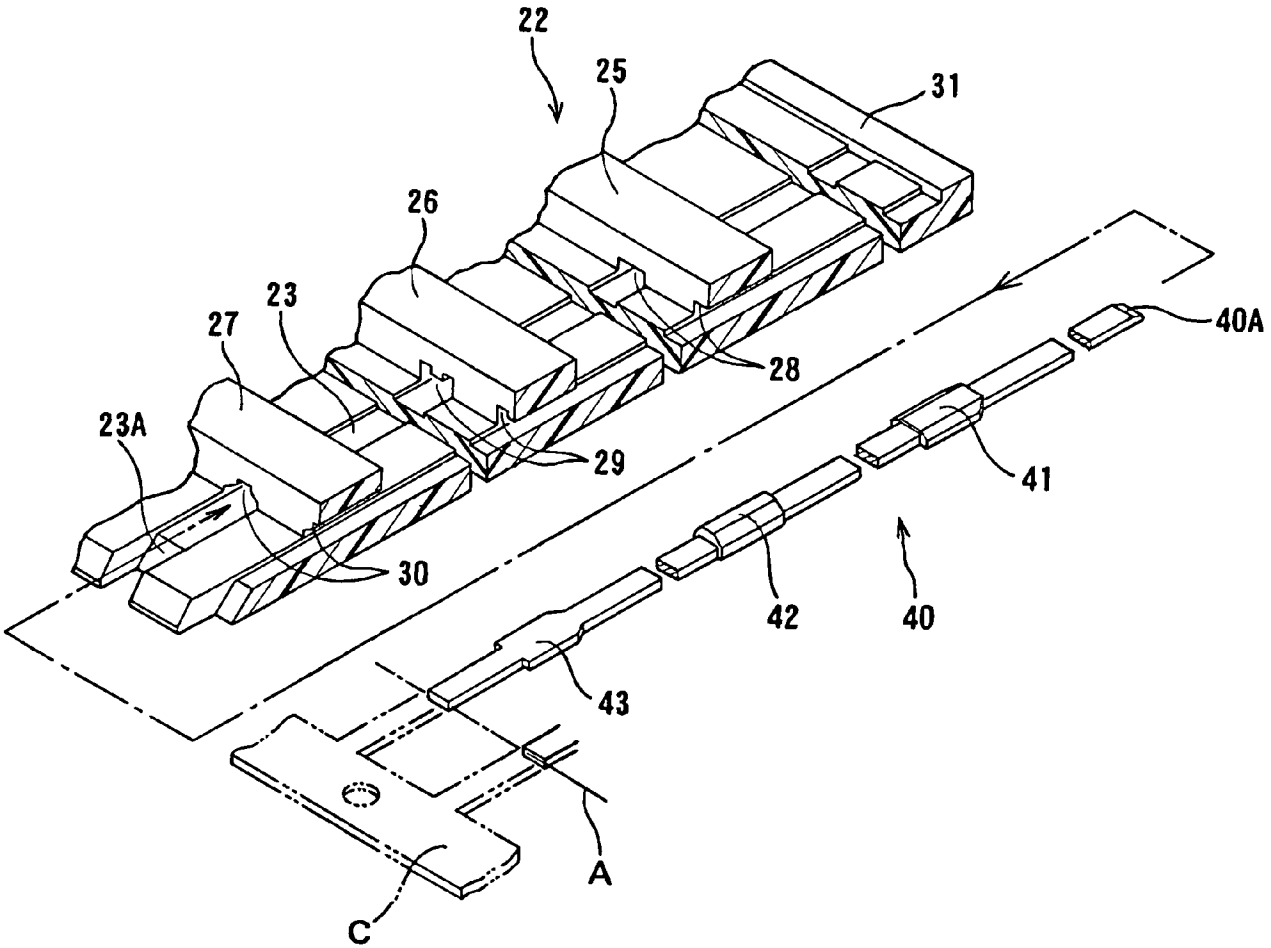
FIG. 4 is a sectional perspective view showing a terminal arrangement plate of the middle member of the middle electrical connector according to the embodiment of the present invention.

As shown in FIG. 4 showing the sectional view of FIG. 3 taken along the line IV-IV, at portions where the guide groove 23 crosses the protrusion portions 25, 26, and 27, the guide groove 23 passes through front-to-rear of the protrusion portions 25, 26, and 27 to form the retaining grooves 28, 29, and 30. The guide groove 23 extends from the rear portion to the front portion of the terminal arrangement plate 22. The protrusion portions 25, 26, and 27 extend in a direction perpendicular to the guide 23.

In the embodiment, the retaining grooves situated in a front portion, a rear portion, and a middle portion are referred to as the front retaining groove 28, the rear retaining groove 30, and the middle retaining groove 29, respectively. When viewed from a front-to-rear direction in which the guide groove 23 extends, the front retaining groove 28 forms a horizontally long rectangular hole. The middle retaining groove 29 forms a horizontally long rectangular hole having a center portion of a top wall with a downward protrusion. Further, the rear retaining groove 30 forms a hole having a top wall recessed in a center portion and slope portions on the both sides thereof.

In the embodiment, the terminal 40 has a section that is in an approximate strip shape of a horizontally long rectangle. Further, at least one of a width or a height of the terminal 40 is to be large in portions corresponding with the retaining portion 28, 29, and 30. Accordingly, retained portions 41, 42, and 43 are pressed to fit into and held by the retaining portion 28, 29, and 30.

The front retained portion 41 in a front portion has a shape in which both sides of a top portion of a rectangle have a slope surface. The middle retained portion 42 has a shape in which a center of a top portion is taller than the front retained portion 41. Further, the rear retained portion 43 is in a horizontally long rectangle shape. Relations of shapes and dimensions between the retained portions 41, 42, and 43 and the retaining grooves 28, 29, and 30, respectively, will be described later.

A front edge of the terminal 40 has a taper portion 40A on an upper surface thereof. Further, a plurality of the terminals 40 is connected to each other through a career C before attached to the terminal arrangement plate 22 and is separated from the career C in a position A that is a rear edge after attaching to the terminal arrangement plate 22. A taper portion 23A is provided on a rear edge of the guide groove 23 so as to easily install the terminal 40 on the guide groove 23, while the regulating portion 31 is provided on a front edge. A height of the regulating portion 31 is determined so that a recess portion to receive a front edge of the terminal is provided or the height is the same as or slightly lower than a front portion of the terminal 40 when the terminal 40 is attached.

Figure 5:
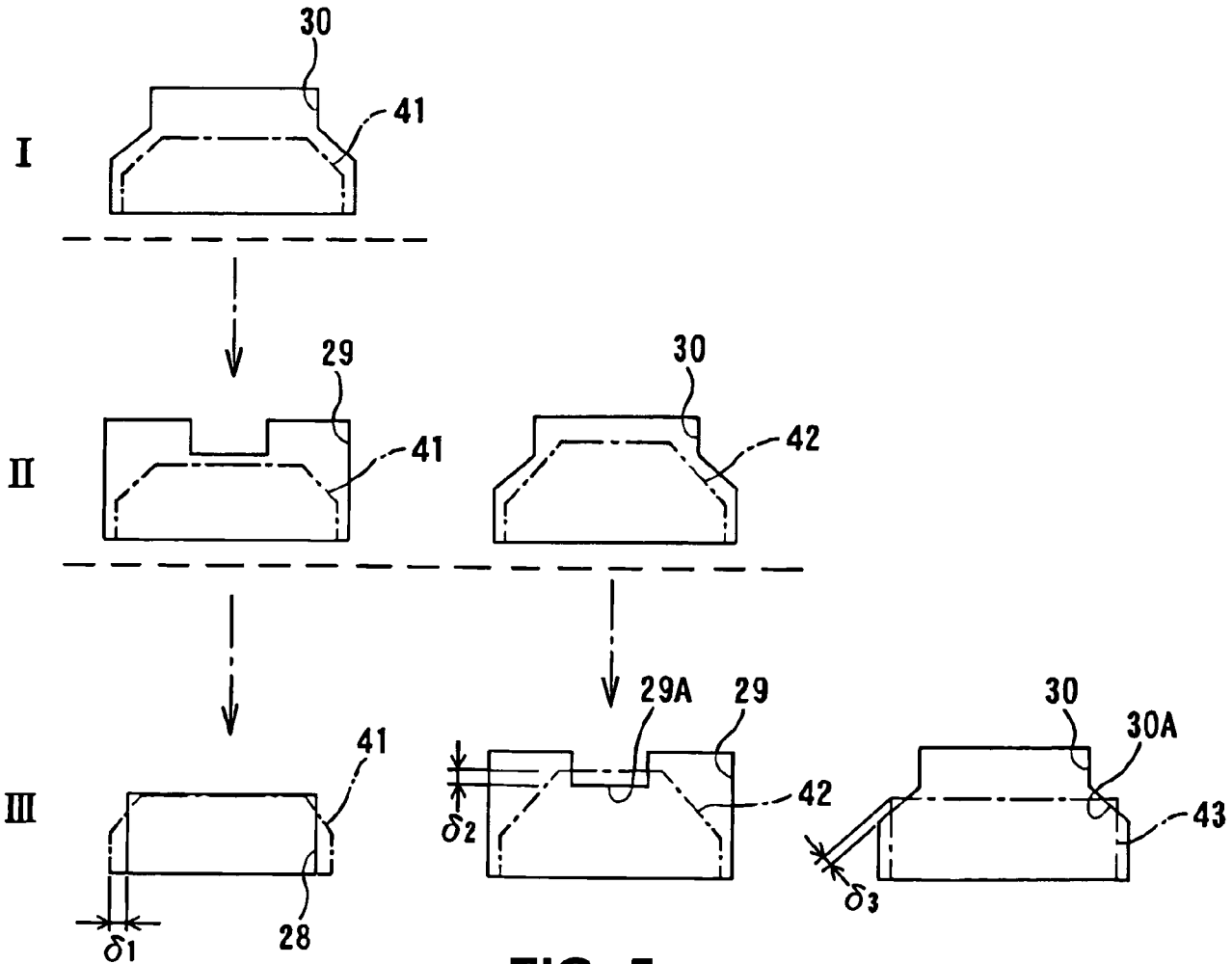
FIG. 5 is a schematic view showing a process of assembling the middle electrical connector according to the embodiment of the present invention.

Next, according to FIG. 5, the relation between the retained portions 41, 42, and 43 and the retaining grooves 28, 29, and 30 of the terminal arrangement plate 22, respectively, will be explained. FIG. 5 shows the relations at an insertion beginning timing I, an insertion in-progress timing II, and an insertion completion timing III.

The insertion beginning timing I represents a period of time when the front retained portion 41 of the terminal 40 passes through the rear retaining groove 30. The insertion in-progress timing II represents a period of time when the front retained portion 41 passes through the middle retaining groove 29 and the middle retained portion 42 passes through the rear retaining groove 30. The insertion completion timing III represents a period of time when the front retained portions 41, 42, and 43 are pressed to fit into the front retaining grooves 28, 29, and 30, respectively. In FIG. 5, a solid line indicates the retaining groove, while a projected line indicates an outline of the retained portion.

First, as the insertion completion timing III (lower figure of FIG. 5) shown in FIG. 5, dimensions of each members when each of the retained portions 41, 42, and 43 of the terminal 40 is pressed to fit into the retaining grooves 28, 29, and 30 situated to correspond to the retained portions will be explained.

At the insertion completion timing III, a size of the front retained portion 41 is substantially the same as that of the front retaining groove 28 in a top-to-bottom direction. However, a size of the front retained portion 41 is larger in a width direction (horizontal direction) and has a contact width $\delta_1$ on both sides in the width direction. The contact width $\delta_1$ is a press-fit amount.

Further, the middle retained portion 42 has a raised portion 29A in a center portion of the top wall of the middle retaining groove 29 and a contact height 62 in a height direction. The contact height 62 is a press-fit amount and receives a downward pressing force upon a press fit. Further, an upper corner portion of the rear retained portion 43 has a contact amount $\delta_3$ in a slope portion 30A formed in an upper side portion of the rear retaining groove 30 in a slope direction. The contact amount $\delta_3$ is a press-fit amount and receives a pressing force toward a center upon the press fit.

Accordingly, the retained portions 41, 42, and 43 of the terminal 40 are pressed to fit into and held by the retaining grooves 28, 29, and 30 upon completion of insertion. Further, the contact amounts $\delta_1$, $\delta_2$, and $\delta_3$ receive the pressing forces toward a center of a width direction and downwardly (or a surface of the terminal arrangement plate 22) to improve a contact with the surface of the terminal arrangement plate 22.

The front retained portion 41 of the terminal 40 at the insertion beginning timing I has no contact with the rear retaining groove 30 situated to correspond and forms space. Accordingly, the front retained portion 41 may pass through to move to a front portion.

Next, at the insertion in-progress timing II of the terminal 40, the front retained portion 41 advances to a position of the middle retaining groove 29. At this time, the middle retained portion 42 enters the rear retaining groove 30. The front retaining portion 41 and the middle retained portion 42 have no contact with the middle retaining groove 29 and the rear retaining groove 30, respectively, and form a space. Accordingly, the terminal 40 can pass through to move to the front and reach a position of the insertion completion timing III.

In the embodiment, the terminal 40 has contact amounts with the retaining grooves 28, 29, and 30 situated to correspond to the retained portions 41, 42, and 43 upon completion of insertion. Further, the terminal 40 has no contact with the retaining grooves correspondingly situated, and forms a space during the insertion beginning timing and the insertion in-progress timing. Accordingly, the terminal 40 is easy to insert until the insertion completion timing. At the completion of insertion, the retained portions 41, 42, and 43 are pressed to fit into and held by the corresponding retaining grooves 28, 29, and 30, respectively, at almost the same time. Further, the terminal receives a downward pressing force upon the press fit and closely contacts with the terminal arrange surface.

Figure 6A:
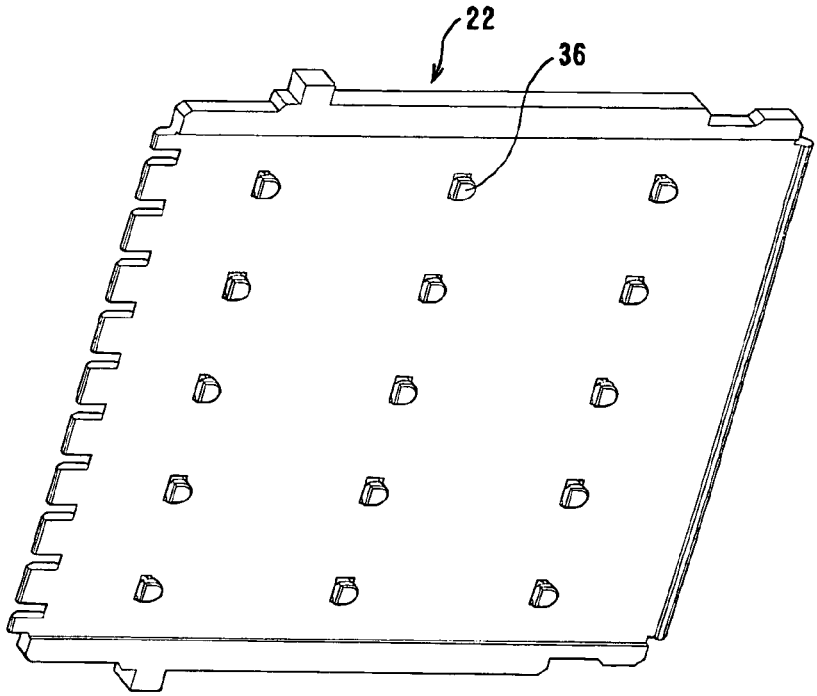
FIGS. 6(A) and 6(B) are perspective views showing the terminal arrangement plate and a shielding plate of the middle member according to the embodiment of the present invention.
Figure 6B:
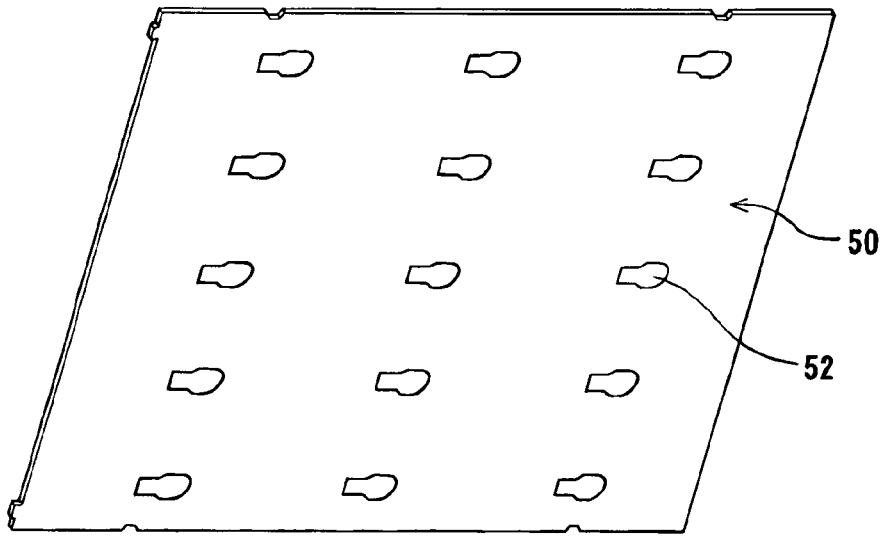

The middle member 20 according to the embodiment has the shielding plate 50 on the other surface of the terminal arrangement plate 22. The terminals 40 are arranged on one surface of the terminal arrangement plate 22. FIG. 6(A) shows the other surface of the terminal arrangement plate 22 before attaching the shielding plate 50, while FIG. 6(B) shows the shielding plate 50.

As shown in FIG. 6(A), the other surface of the terminal arrangement plate 22 is substantially a plane surface, and is provided with a protrusion 36 in a plurality of positions.

Figure 7:
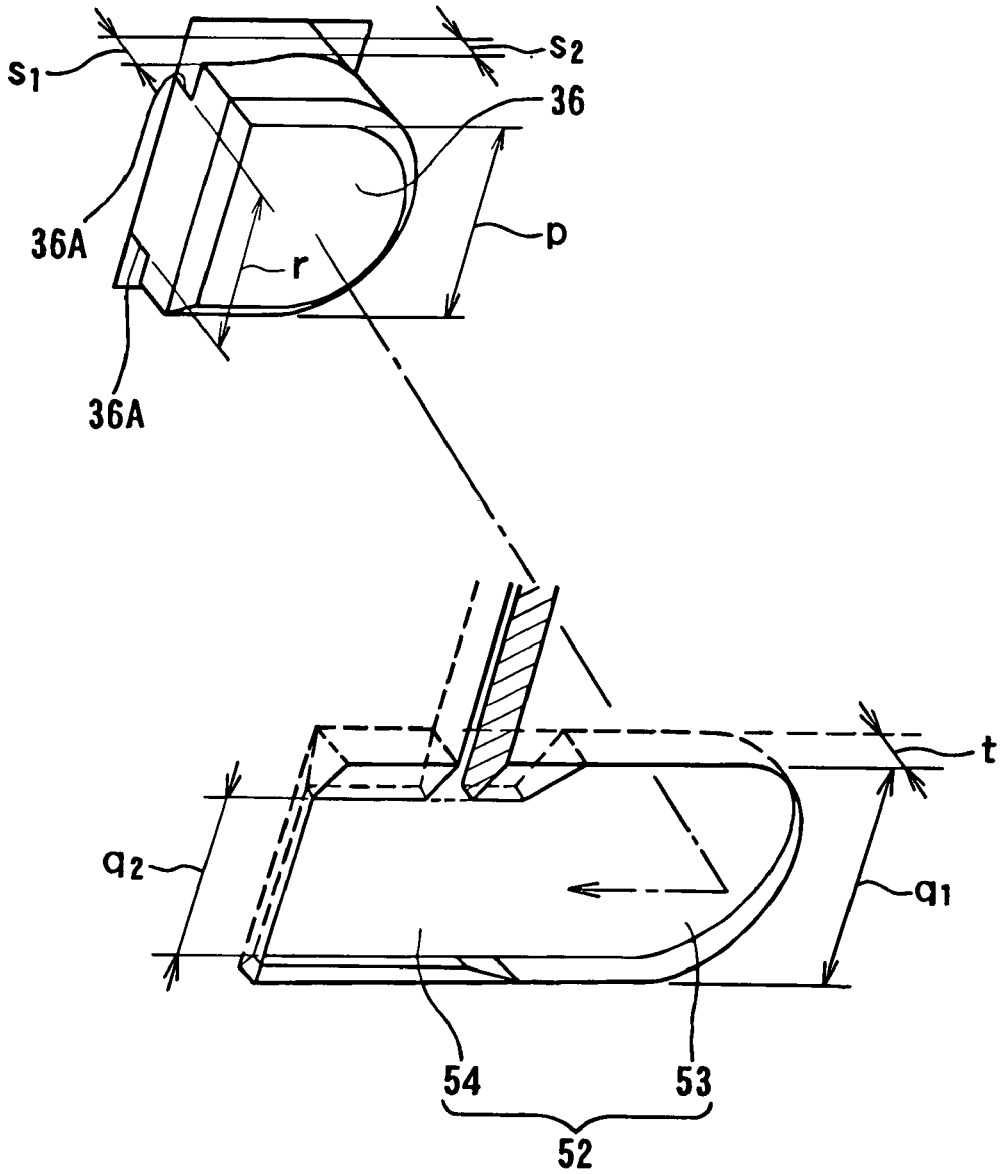
FIG. 7 is a schematic view showing a protrusion formed on the terminal arrangement plate and an engagement hole formed in the shielding plate according to the embodiment of the present invention.

As shown in FIG. 7, a front half (right portion in the figure) of the protrusion 36 is a half cylinder and a rear portion thereof is an approximate rectangle having a width p. Further, a side surface of a base portion of the protrusion 36 has a press fit groove 36A extending front-to-rear. The press fit groove 36A has a slope surface inclined upwardly to a front portion in FIG. 7.

Further, a groove width of the press fit groove 36A becomes narrower toward the front portion in a direction perpendicular to the other surface of the terminal arrangement plate 22. A groove width $S_1$ of a rear portion of the press fit groove 36A is slightly larger than a plate thickness of the shielding plate 50 and a groove width $S_2$ of a front portion thereof is smaller than the plate thickness.

The shielding plate 50 is made to be large enough to cover the other surface of the terminal arrangement plate 22. An engagement hole 52 is provided to pass through in a plate thickness direction in a corresponding position to a plurality of the protrusions 36. FIG. 7 shows the engagement hole 52 in a state before engaging with the protrusion 36. A front portion 53 of the engagement hole 52 has a half circle portion and a parallel edge portion of a width $q_1$ to connect thereto.

Further, a rear portion 54 of the engagement hole 52 is a parallel edge portion of a width $q_2$ narrower than the parallel portion of the front portion 53. The width $q_1$ at a parallel edge portion of the front portion 53 is larger than the width p of the protrusion 36. Further, the width $q_2$ at a parallel edge portion of the rear portion 54 is smaller than the width p of the protrusion 36 and larger than a distance r of the groove bottom portions of the press fit groove 36A of the protrusion 36.

In the parallel edge portion of the rear portion 54 of the width $q_2$, a taper portion is formed for keeping the plate thickness small inward of the engagement hole 52.

In the terminal arrangement plate 22 having the protrusion 36, the protrusion 36 is inserted into the front portion 53 of the engagement hole 52 of the shielding plate 50 and passes through the engagement hole 52 to slide to move the terminal arrangement plate 22 backward. At this time, the shielding plate 50 is adjacent to the other surface of the terminal arrangement plate 22. In other words, the shielding plate 50 relatively moves frontward with respect to the terminal arrangement plate.

Due to the relative move, in the shielding plate 50, the parallel edge portion of the rear portion 54 of the engagement hole 52 enters the press fit groove 36A of the protrusion 36. Further, a slope surface of the press fit groove 36A having a groove width narrowing gradually holds the shielding plate 50 in a closely contact state pressed toward the other surface of the terminal arrangement plate 22.

Accordingly, one of the surfaces of the terminal arrangement plate 22 holds the terminal 40 closely, while the other surface holds the shielding plate 50 closely to obtain a single middle member 20. As shown in FIG. 3, a plurality of the middle member 20 is held with the housing 11 as in FIG. 2 to obtain the middle connector M. In the middle connector M, as shown in FIG. 2, the connectors are connected from directions A and B and are connected to each other through the middle connector M.

Figure 8:
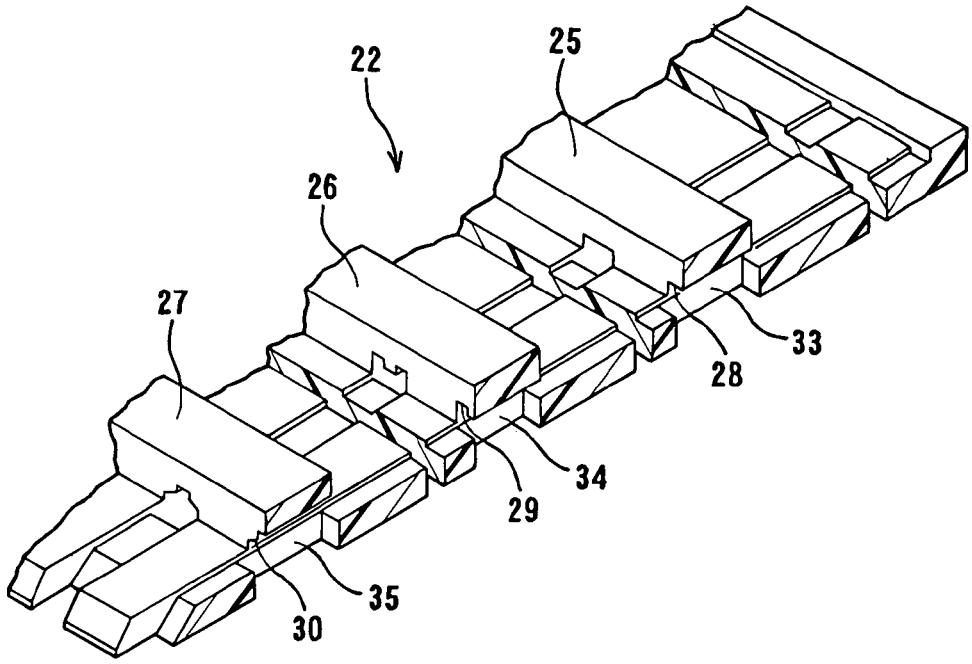
FIG. 8 is a sectional perspective view showing a modified example of the terminal arrangement plate of the middle member according to the embodiment of the present invention.

The present invention is not limited to the examples shown FIGS. 1 to 7, and modifications may be possible. For example, as shown in FIG. 8, each of the retaining grooves 28, 29, and 30 of the terminal arrangement plate 22 may communicate with each of window portions 33, 34, and 35. The window portions 33, 34, and 35 pass thorough a plate thickness direction of the terminal arrangement plate 22.

Accordingly, a part of the terminal arrangement plate 22 does not exist in a lower side of the terminal 40 in the retaining grooves 28, 29, and 30, while top wall portions of the protrusion portions 25, 26, and 27 exist only on an upper side of the terminal 40. Accordingly, even though the retained portions 41, 42, and 43 of the terminal 40 have a wider width compared to other portions, a permittivity with the shielding plate 50 in this portion may be adjusted. Thus, an impedance matching can improve a high speed transmission characteristic of the terminal over an entire length of the terminal 40.

Figure 9:
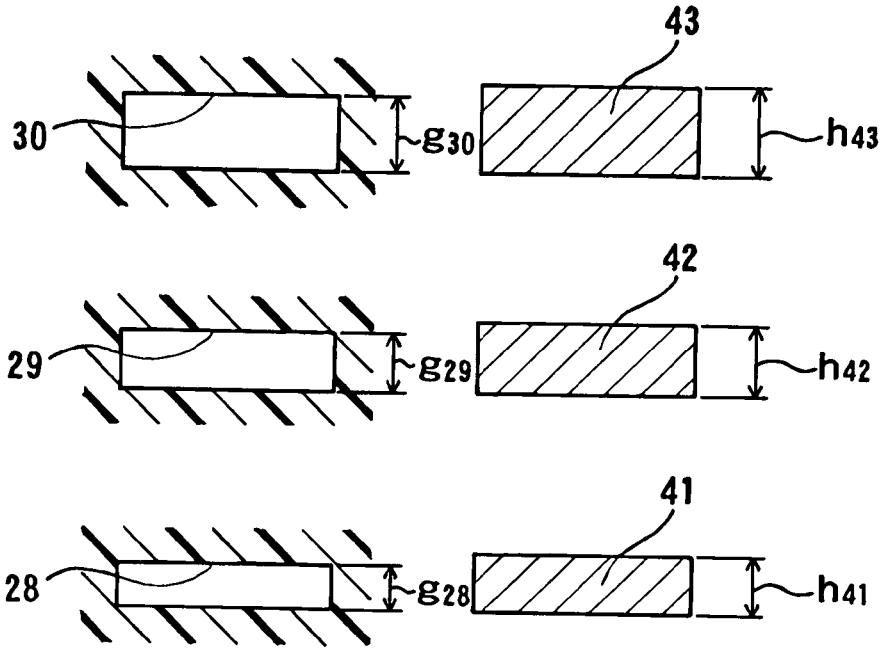
FIG. 9 is a schematic view showing a modified example of a retained portion of a terminal and a retaining groove of the terminal arrangement plate.

Further, relations of shapes and sizes between each of the retained portions of the terminals and the corresponding retaining grooves may be varied. The variations may be other than the examples shown in FIGS. 1-7. For example, as shown in FIG. 9, when the retained portions 41, 42, and 43 and the retaining grooves 28, 29, and 30 have a rectangular section shape having the same width, only a height direction of retained portions 41, 42, and 43 and the retaining grooves 28, 29, and 30 may be varied. Then, the retained portion passes through the retaining groove during the insertion beginning timing and the insertion in-progress timing and the retained portions 41, 42, and 43 may be pressed to fit into and held by the retaining grooves 28, 29, and 30 at the insertion completion timing.

The same relationship may be applied to the other variation described below. In FIG. 9, the retained portions 41, 42, and 43 and the corresponding retaining grooves 28, 29, and 30 at the insertion completion timing are shown side by side in a horizontal direction thereof. A height $h_{41}$ of the front retained portion 41 in a height direction is larger than a height $g_{28}$ of the front retaining groove 28 in the direction and smaller than heights $g_{29}$ and $g_{30}$ of a middle retaining groove 29 and the rear retaining groove 30 in the same direction.

Further, a height $h_{42}$ of the middle retained portion 42 in a height direction is larger than the height $g_{29}$ of the middle retaining groove 29 in the direction and smaller than the height $g_{30}$ of the rear retaining groove 30 in the same direction. Further, a height $h_{43}$ of the rear retained portion 43 in a height direction thereof is larger than the height $g_{30}$ of the rear retaining groove 30 in the same direction. These heights have a relationship of $g_{28}<h_{41}<g_{29}<h_{42}<g_{30}<h_{43}$.

Accordingly, in the example of FIG. 9, each of the front retained grooves 41, 42, and 43 is held by the retaining grooves 28, 29, and 30 receiving pressing force downwardly on an upper surface side of the retained portion upon completion of insertion of the terminal.

Figure 10:
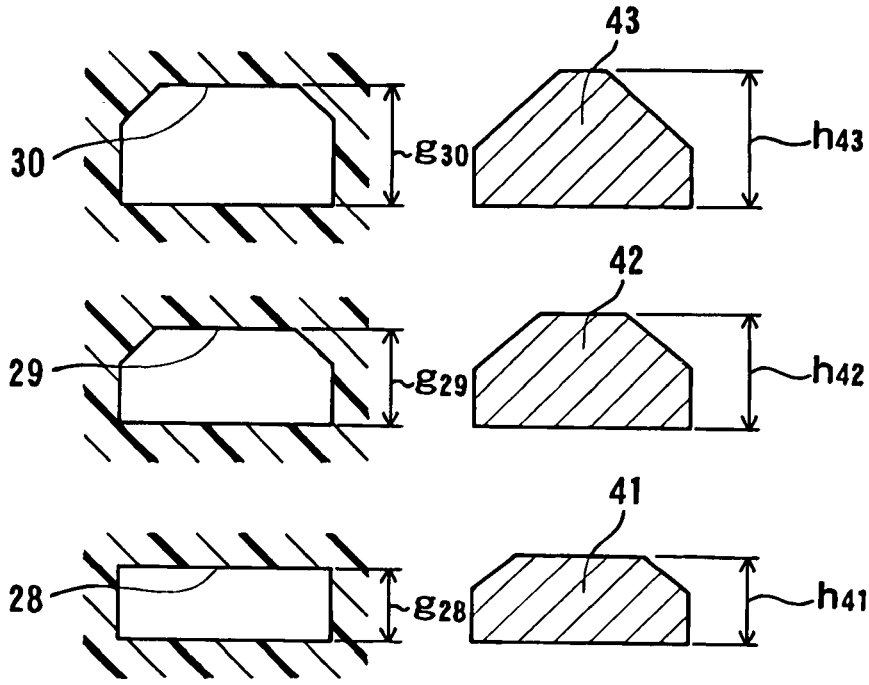
FIG. 10 is a schematic view showing another modified example of the retained portion of the terminal and the retaining groove of the terminal arrangement plate.

Similar to FIG. 9, even though the pressing force from the corresponding retaining groove is received downwardly on an upper surface side of the retained portion of the terminal, a slope surface may be provided in both upper corner portions of each of the retained portions 41, 42, and 43 of the terminal as shown in FIG. 10.

In the modified example shown in FIG. 10, a relation of heights between the retained portions 41, 42, and 43 and the retaining grooves 28, 29, and 30 provided to correspond to the retained portions 41, 42, and 43 is $g_{28}<h_{41}<g_{29}<h_{42}<g_{30}<h_{43}$ similar to in the case of FIG. 9.

In the modified example shown in FIG. 10, since each of the retained portions 41, 42, and 43 has a slope surface in the both upper corner portions, a width of a horizontal upper surface portion that contacts with the retaining groove is relatively small. Accordingly, a contact dimension in a height direction is to be enlarged in order to secure enough contact amounts.

Further, in the modified example shown in FIG. 10, the front retaining groove 28 is a rectangle, while the middle retaining groove 29 and the rear retaining groove 30 have a top slope surface. The middle retaining groove 29 allows the front retained portion 41 to pass through, while the rear retaining groove 30 allows the front retained portion 41 and the middle retained portion 42 to pass through.

In the modified examples shown in FIGS. 9 and 10, a height of the horizontal upper surface portion of the retained portions 41, 42, and 43 is larger than that of the corresponding retaining grooves 28, 29, and 30, so that the retained portions 41, 42, and 43 can contact with the retaining grooves 28, 29, and 30.

Figure 11:
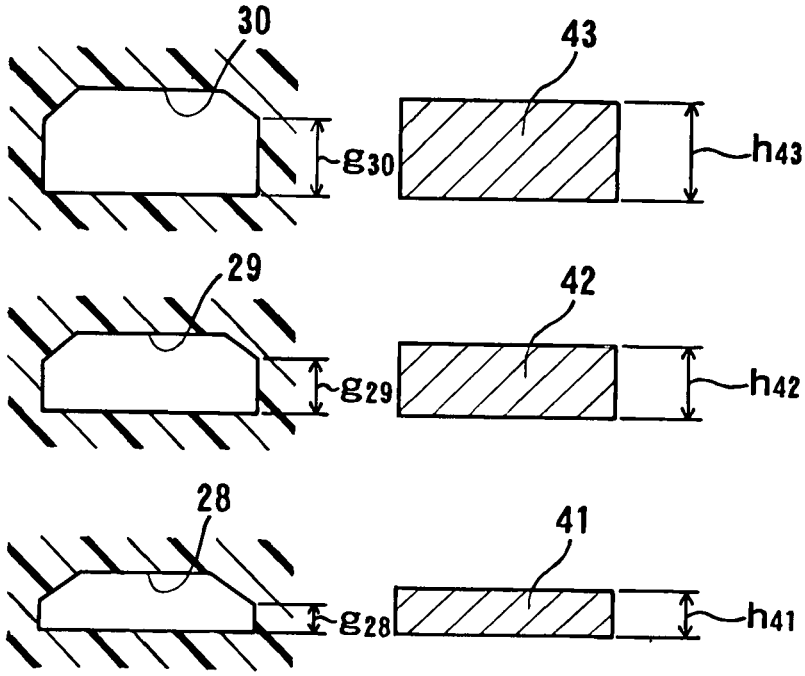
FIG. 11 is a schematic view showing a further modified example of the retained portion of the terminal and the retaining groove of the terminal arrangement plate.

As shown in FIG. 11, a width of the retained portions 41, 42, and 43 may be substantially the same as that of the corresponding retaining grooves 28, 29, and 30. While the retained portions 41, 42 and 43 are in a rectangular shape, each of the retaining grooves 28, 29, and 30 has a slope surface in an upper corner portion. The slope surface contacts with the perpendicular corner portions on both sides of an upper portion of the retained portion 41, 42, and 43 to hold and apply an obliquely downward pressing force to the terminals.

A relationship between the heights of the retained portions 41, 42, and 43 and heights of the retaining grooves 28, 29, and 30 from a lower surface to a lower edge of the slope surface is to be $g_{28}<h_{41}<g_{29}<h_{42}<g_{30}<h_{43}$. That is, an upper surface of the retained portion 41, 42, and 43 in a height direction is situated within the slope surface of the corresponding retaining grooves 28, 29, and 30.

In the modified examples shown in FIGS. 10 and 11, although the angle of the slope in all the retained portions and the slope surfaces was the same, the angle of the slope may be varied.

Figure 12:
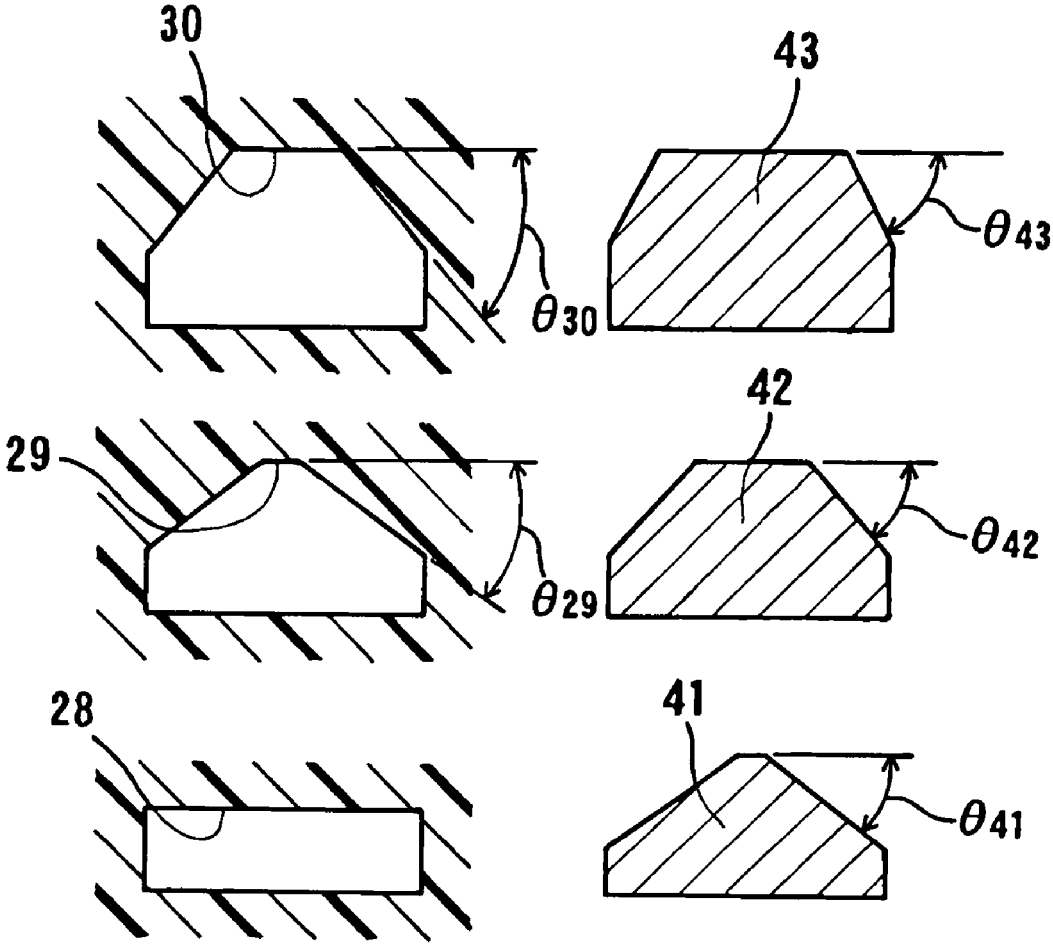
FIG. 12 is a schematic view showing a still further modified example of the retained portion of the terminal and the retaining groove of the terminal arrangement plate.

As shown in FIG. 12, the front retained portion 41 may have a slope surface of an angle $\theta_{41}$, and a top portion thereof is higher than that of the front retaining groove 28, so that the front retained portion 41 can be pressed to fit into the front retaining groove 28 due to the height difference.

A height dimension of the middle retaining groove 29 is slightly larger than the front retained portion 41 and the angle $\theta_{29}$ of the slope surface is equal to $\theta_{41}$. Accordingly, the middle retaining groove 29 allows the front retained portion 41 to pass through. Further, the middle retaining groove 29 contacts with the middle retained portion 42. A height of the middle retained portion 42 is the same as that of the middle retaining groove 29. However, an angle of the slope surface $\theta_{42}$ is larger than the angle $\theta_{29}$ ($\theta_{42}>\theta_{29}$). Accordingly, the middle retaining groove 29 contacts with the middle retained portion 42 on the slope surfaces and obliquely downward pressing force is applied to the terminals.

Further, a height of the rear retaining groove 30 is slightly larger than that of the middle retaining portion 42. That is, an angle of a slope surface $\theta_{30}$ is equal to $\theta_{42}$ to allow the middle retained portion 42 to pass through. Further, a height of the rear retaining groove 30 is the same as that of the rear retained portion 43. However, an angle of the slope surface $\theta_{43}$ is larger than the angle $\theta_{30}$ ($\theta_{43}>\theta_{30}$). Accordingly, the rear retaining groove 30 contacts with the rear retained portion 43 on the slope surfaces and obliquely downward pressing force is applied to the terminals.

The disclosure of Japanese Patent Application No. 2007-234810, filed on Sep. 11, 2007 is incorporated in the application by reference.

While the invention has been explained with reference to the specific embodiments of the invention, the explanation is illustrative and the invention is limited only by the appended claims.

What is claimed is:

1. A middle electrical connector for connecting a mating connector, comprising:

a housing made of an electrical insulation material;

a terminal arrangement plate disposed in the housing, said terminal arrangement plate including a guide groove extending linearly in a first direction, said terminal arrangement plate further including a protrusion portion extending linearly in a second direction perpendicular to the first direction and crossing over the guide groove, said protrusion portion having a first retaining groove and a second retaining groove each situated over the guide groove, said first retaining groove having at least one of a shape and a size different from that of the second retaining groove; and a terminal arranged on the terminal arrangement plate and retained in the guide groove, said terminal including a first retained portion and a second retained portion, said first retained portion being tightly fitted in the first retaining groove, said second retained portion being tightly fitted in the second retaining groove.

2. The middle electrical connector according to claim 1, wherein at least one of said first retaining groove and said second retaining groove is arranged to press corresponding one of the first retained portion and the second retained portion.

3. The middle electrical connector according to claim 1, wherein said first retaining groove and said second retaining groove are disposed at positions corresponding to the first retained portion and the second retained portion.

4. The middle electrical connector according to claim 1, wherein said terminal arrangement plate further includes a guide groove for guiding the terminal, said guide groove communicating with the first retaining groove and the second retaining groove.

5. The middle electrical connector according to claim 1, wherein said terminal arrangement plate further includes a regulating portion for regulating a front edge of the terminal.

6. The middle electrical connector according to claim 1, wherein said terminal arrangement plate further includes a window portion at a position corresponding to at least one of the first retaining groove and the second retaining groove.

7. The middle electrical connector according to claim 1, wherein at least one of said first retained portion and said second retained portion has a cross section larger than that of the terminal.

8. The middle electrical connector according to claim 1, wherein said terminal arrangement plate further includes a shielding plate.

9. The middle electrical connector according to claim 8, wherein said terminal arrangement plate further includes a protrusion for engaging an engagement hole formed in the shielding plate.

10. The middle electrical connector according to claim 9, wherein said protrusion includes a press fit groove for engaging an inner edge of the engagement hole.

11. The middle electrical connector according to claim 10, wherein said press fit groove has a width decreasing toward one direction so that the shielding plate is pressed against the terminal arrangement plate.

* * * * *